US007887133B2

(12) United States Patent
Perk

(10) Patent No.: US 7,887,133 B2
(45) Date of Patent: Feb. 15, 2011

(54) STAND-UP WHEELCHAIR

(75) Inventor: Heinrich Perk, Aglasterhausen (DE)

(73) Assignee: Otto Bock Healthcare IP GmbH & Co. KG, Duderstadt (DE)

( * ) Notice: Subject to any disclaimer, the term of this patent is extended or adjusted under 35 U.S.C. 154(b) by 448 days.

(21) Appl. No.: 12/063,417

(22) PCT Filed: Aug. 3, 2006

(86) PCT No.: PCT/DE2006/001360

§ 371 (c)(1),
(2), (4) Date: Feb. 8, 2008

(87) PCT Pub. No.: WO2007/016907

PCT Pub. Date: Feb. 15, 2007

(65) Prior Publication Data

US 2010/0164268 A1 Jul. 1, 2010

(30) Foreign Application Priority Data

Aug. 8, 2005 (DE) ..... 10 2005 038 030

(51) Int. Cl.
*A61G 5/14* (2006.01)

(52) U.S. Cl. ..... 297/344.15; 297/344.17; 297/383; 297/DIG. 10; 248/564

(58) Field of Classification Search ..... 297/344.12, 297/344.15, 344.17, 376, 383, DIG. 10
See application file for complete search history.

(56) References Cited

U.S. PATENT DOCUMENTS 1,685,770 A * 10/1928 Bowen ..... 297/326
1,734,179 A * 11/1929 Olson ..... 297/230.14
2,432,554 A * 12/1947 Knoedler ..... 248/564
3,138,402 A * 6/1964 Heyl, Jr. et al. ..... 297/69
3,268,200 A * 8/1966 Eicher ..... 248/564

(Continued)

FOREIGN PATENT DOCUMENTS

| | | |
|---|---|---|
| CA | 2 458 092 | 2/2004 |
| CA | 2 458 122 | 2/2004 |
| DE | 19912830 | 9/2000 |
| EP | 1 413 278 | 4/2004 |

(Continued)

OTHER PUBLICATIONS

International Search Report for PCT/DE2006/001360 mailed Aug. 12, 2006, 6 pages.

*Primary Examiner*—Joseph Edell
(74) *Attorney, Agent, or Firm*—Holland & Hart, LLP

(57) ABSTRACT

The invention relates to a stand-up wheelchair comprising a frame (29) to which two drive wheels (30) and at least one steerable wheel (31) are fixed. A stand-up unit (33) provided with a height-adjustable seat (3), a back rest (7), and at least one foot rest (32), is pivotably arranged on said wheelchair. The inventive wheelchair is characterized in that the seat (3) is mounted, on both sides, on an articulation parallelogram structure consisting of an upper longitudinal rail (1) which is connected to the seat (3) in a fixed manner and comprises a front articulation point (10) and a rear articulation point (11), a lower longitudinal rail (2) comprising a front articulation point (12) and a rear articulation point (13), and two guides (4, 19) connecting the front articulation points (10, 12) and the rear articulation points (11, 13). The inventive wheelchair is also characterized in that the parallelogram structure can be displaced by a lifting device (36) in order to adjust the height of the seal (3).

13 Claims, 7 Drawing Sheets

U.S. PATENT DOCUMENTS 3,302,971 A * 2/1967 Lory ..... 297/344.14
3,806,075 A * 4/1974 Sturhan ..... 248/564
3,851,917 A * 12/1974 Horstmann et al. .... 297/344.15
4,390,076 A * 6/1983 Wier et al. ..... 180/11
5,203,610 A * 4/1993 Miller ..... 297/344.16
5,346,280 A 9/1994 Deumite
5,556,121 A * 9/1996 Pillot ..... 280/304.1
5,772,226 A * 6/1998 Bobichon ..... 280/250.1
6,000,758 A * 12/1999 Schaffner et al. ..... 297/344.17
6,244,662 B1 * 6/2001 Porcheron ..... 297/383
7,134,721 B2 * 11/2006 Robinson ..... 297/284.3

FOREIGN PATENT DOCUMENTS

EP 1488770 A1 * 12/2004
EP 1 506 760 2/2005
JP 2003079668 3/2003
JP 2003235902 8/2003
WO 03/103561 12/2003

* cited by examiner

STAND-UP WHEELCHAIR

This patent application is the national stage of International Application No. PCT/DE2006/001360, which claims priority to German Application No. 10 2005 038 030.1 filed Aug. 8, 2005; the entire contents of both applications are hereby expressly incorporated by reference.

TECHNICAL FIELD

The invention refers to a standing wheelchair with a chassis frame to which two drive wheels and at least one steerable wheel are connected, equipped with an uplift unit with a height adjustable seat, a backrest and at least one pivotable foot support.

BACKGROUND OF THE INVENTION

This type of wheelchair is known from CA 2 458 122 A1 or DE 199 12 830. The constant seated position of the user leads to degradation of bodily functions over long periods of time, such as reduced movement of the lower extremities, deceleration of intestinal activity and the impairment of blood circulation. Sitting also increases the risk of decubitus ulcers. A standing wheelchair aids in reducing these consequences through changes in body position, up to a standing position, which reduces the degradation of bodily functions. The movable seat surface is mounted on a chassis frame with backrest and foot supports. The correct adjustment to the anatomical requirements of the user is a very important criterion for comfort, which the wheelchair offers. Through this, the relation of seat depth and lower leg as well as upper leg to the position of the footrest is determined using the body measurements of the user. In accordance with the dimensions provided, a standing wheelchair is selected from the standard manufacturer program and produced.

User specific manufactured wheelchairs often provide unsatisfactory comfort for small and large people, because the standardized sizes of the standing wheelchairs are based on average body sizes. Often, the lack of adjustment is only indirectly perceived by the user. Friction movement between the body and the seat or an overly strong surface pressure from the kneepads can lead to decubitus ulcers in a short period of usage time. If the seat is adjusted, the angle of the seat is changed in the known wheelchairs, which is uncomfortable.

Standing wheelchairs offer the user the option to participate in sports activities. Thus the user can play golf, for example. In these cases it is particularly important that the wheelchair offer a high degree of stability in the upright position. Thus there is a requirement that the foot supports stand on the floor in the upright position and are supported by it. The backrest must be parallel to the seat and the golfer must have sufficient freedom of movement (turning of the upper body) in order to be able to swing a club.

In such a case, standing wheelchairs are often kept at the ready at golf courses and used by various users. Wheelchairs designed for people of average size can be used by a range of disabled persons only under great loss of comfort, because the seat height is not optimally adjustable.

From CA 2 458 092, an adjustable wheelchair is known. The seat depth can be changed by an adjustable backrest. The backrest is telescoping and connected to the lower chassis of the seat. The telescoping rods are not particularly functional in practical use. In order to guarantee stability, low tolerances are required. Frequent adjustment leads to wear and tear. The bilateral telescoping rods under the seat can tilt toward each other. The backrest is then not straight in relation to the seat and secure uplift of the wheelchair is not possible. Telescoping rods also collect dirt, which is unavoidable during sports activities.

EP 1 413 278 A1 publishes a wheelchair, in which the seat is adjustable in height via a jointed parallelogram, which is pivotable. With the change of the seat height, the position of the seat in the direction of travel is also changed. According to the configuration of the parallelogram, the seat is repositioned either forward or backward when in motion.

SUMMARY OF THE INVENTION

Starting with this problem, the standing wheelchair described at the beginning should be improved so that the seat height is adjustable, without changing the angle of the seat or the distance of the foot supports to the ground, as it remains constant regardless of the seat height.

For the solution to this problem, a generic standing wheelchair is proposed, which is characterized in that the seat is supported on a top longitudinal track connected to the seat with a front hinge point, and a lower longitudinal track with front and back hinge points as well as two guides attached to the front and back hinge points forming a parallelogram. The parallelogram is movable with a hub unit for adjustment of the seat height, without significant changes to the relative position of the longitudinal tracks.

By movement of the hinge parallelogram upward and back, the seat height can be changed without changing the angle of the seat to the backrest. Geometric changes can be counteracted if necessary with steering guides. The foot support can be completely removed from the height adjustment and its movement controlled by the uplift kinematics.

For this, the hub unit functions preferably with a longitudinal strut attached at its front end to the front hinge point of the lower longitudinal track and at its back end by hinge point to the chassis and with a steering strut attached at the front end via a hinge with the upper longitudinal track and at the back end via a hinge attached to the chassis.

The steering strut and the longitudinal strut, which are attached to the chassis, push the front part of the seat and frame (on which the seat is positioned) upward in parallel position, so that there is no sinking of the front section. This only changes the relative position of the seat to the chassis. When raising the seat, this only tilts slightly backward.

It is advantageous if the front hinge point of the upper longitudinal track, the hinge point of the longitudinal strut attached to the chassis, the front hinge point of the steering strut and the back hinge point of the steering strut form a jointed parallelogram.

It is particularly advantageous, if the seat is continually adjustable. For this a spindle can be used. This is then particularly advantageous when the spindle is self-locking.

Because both of the jointed parallelograms are situated to either side of the seat, two hub units can also be attached.

If the back ends of the longitudinal tracks have a slot in them, in which the backrest is attached at its lower ends to be movable, the seat depth is also adjustable, so that an optimal seat position can be achieved by the user.

A slot configuration is very robust and resistant to collection of dirt.

If the backrest is adjustable and securable in the slots via slide blocks, low tolerances can be maintained. The slide blocks offer the option of stageless adjustment of the seat depth, canting of the backrest is ruled out, so that the seat and backrest are able to pivot even under rough conditions. Preferably, every slide block is attached to a plate, which is connected with the backrest via hinges. These plates can be attached to each other via a hinge handle, so that the handles clasp the seat during adjustment of the backrest, and aid in sliding the backrest into the slots.

It is advantageous if the longitudinal tracks have recesses parallel to the slots, into which one of the locking pins connected to the backrest can be inserted. The locking pins can be located on the grip elements. The recesses offer the advantage, with the locking pins, that the backrest can be fixed in place before the slide blocks are screwed into the slots. They also offer the advantage that the backrest is also held in place, if the screws loosen.

The recesses are preferably situated at regular intervals, whereby a grid is realizable for the backrest. Instead of recesses, bore holes can also be used.

On the back ends, the longitudinal tracks can also be attached together via a strap.

With the aid of a drawing, the design example of the invention can be more closely described.

DETAILED DESCRIPTION

Figure 1:
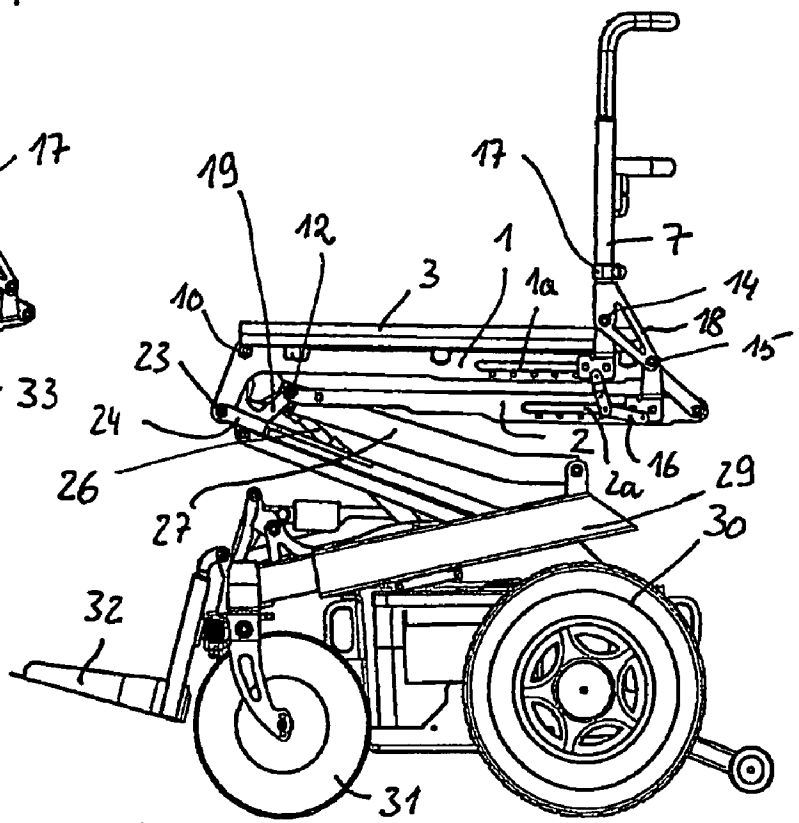
FIG. 1: A standing wheelchair in a side view.
Figure 2:
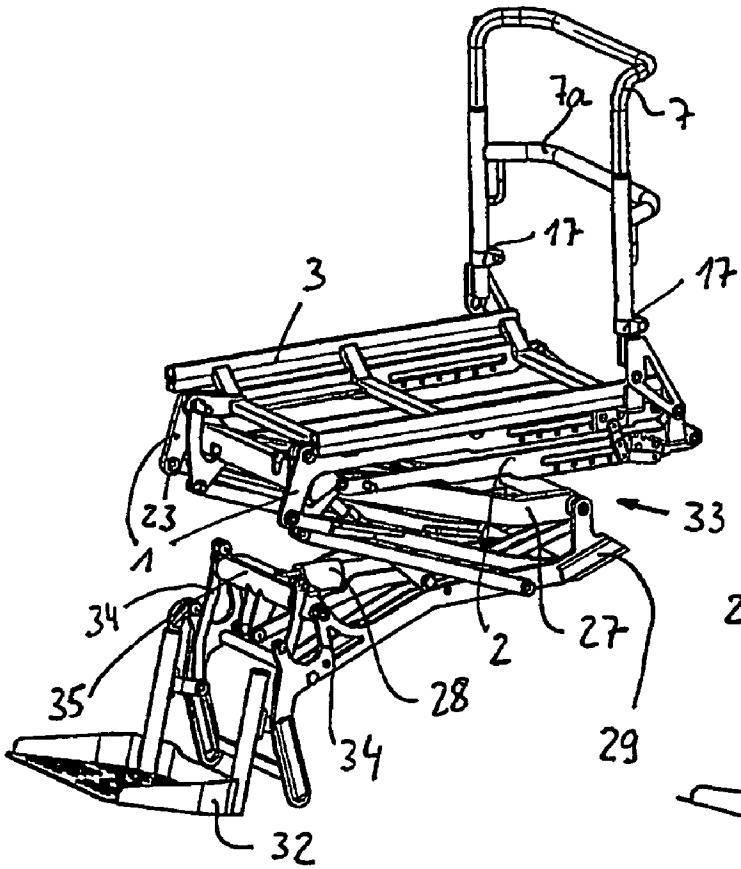
FIG. 2: The uplift unit.
Figure 3:
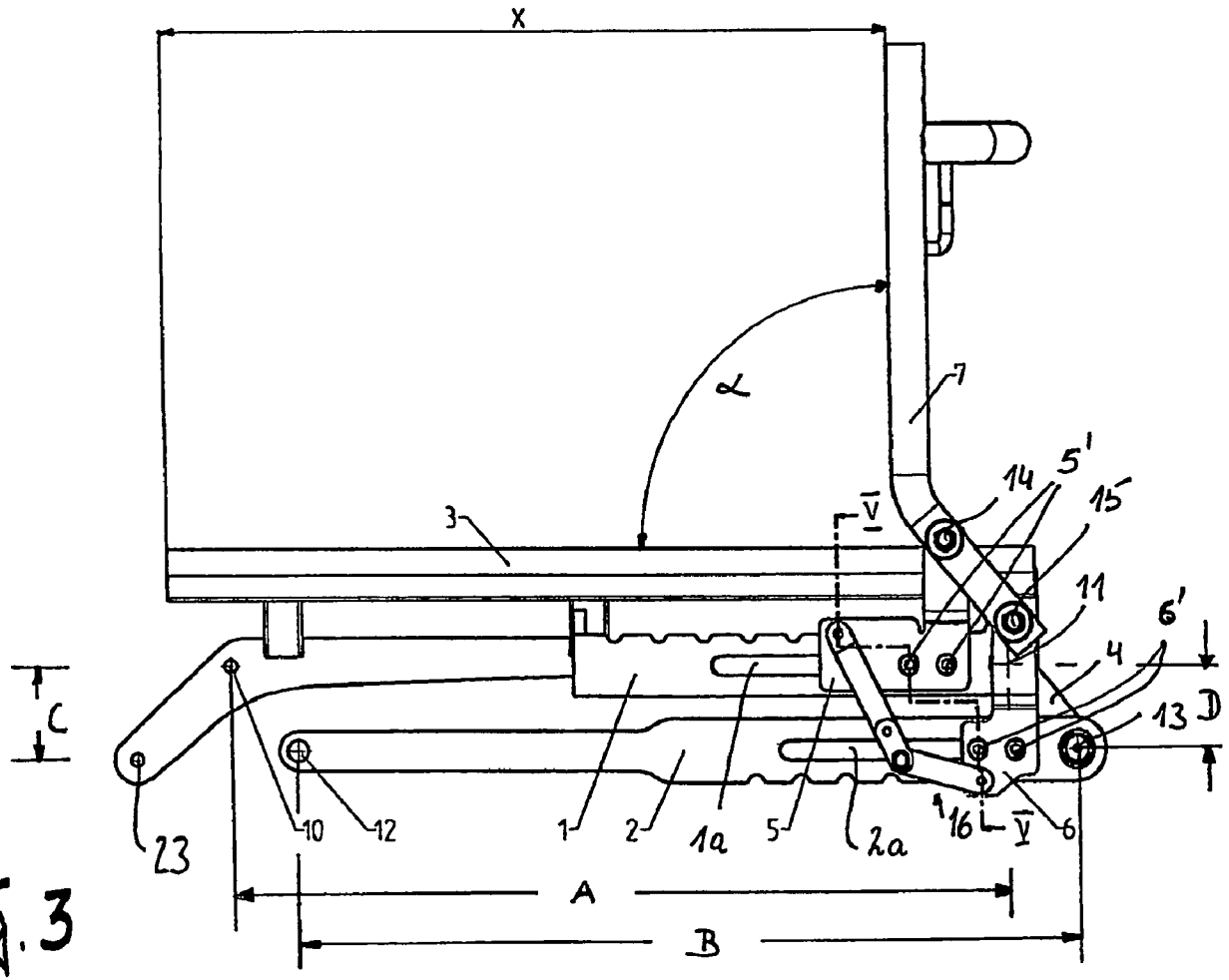
FIG. 3: The partial representation of the adjustment kinematics.

The wheelchair consists of the chassis 29 with the uplift unit 33 attached, the drive wheels 30 and both steerable front wheels 31. The uplift unit 33 has a seat 3, a backrest 7 and a foot support 32. Via an actuator 28, the uplift unit 33 can be rotated. The seat 3 then moves to a vertical position. The backrest 7 retains its vertical position and is located parallel to the seat 3. Simultaneously with the tilting of the seat 3, the foot support 32 sinks and is supported on the ground in the extended position of the uplift unit 33. To lift the seat 3 and the backrest 7, the actuator 28 moves the cross strut 22 and the hinge point 21 along a longitudinal track.

Under the seat 3, there are two longitudinal tracks 1, 2. The upper track 1 is attached to the seat 3 and has a front hinge point 10 and a back hinge point 11. The lower track 2 has a front hinge point 12 and a back hinge point 13. Via the hinge points 10, 12; 11, 13, the upper track 1 and the lower track 2 are attached to each other, whereby a parallelogram is formed. That is, the distance C from the front hinge points 10,12 is identical to distance D of the back hinge points 11,13 and distance A of hinge points 10,11 of the upper track 1 is identical to distance B of the hinge points 12, 13 of the lower track 2.

Figure 4:
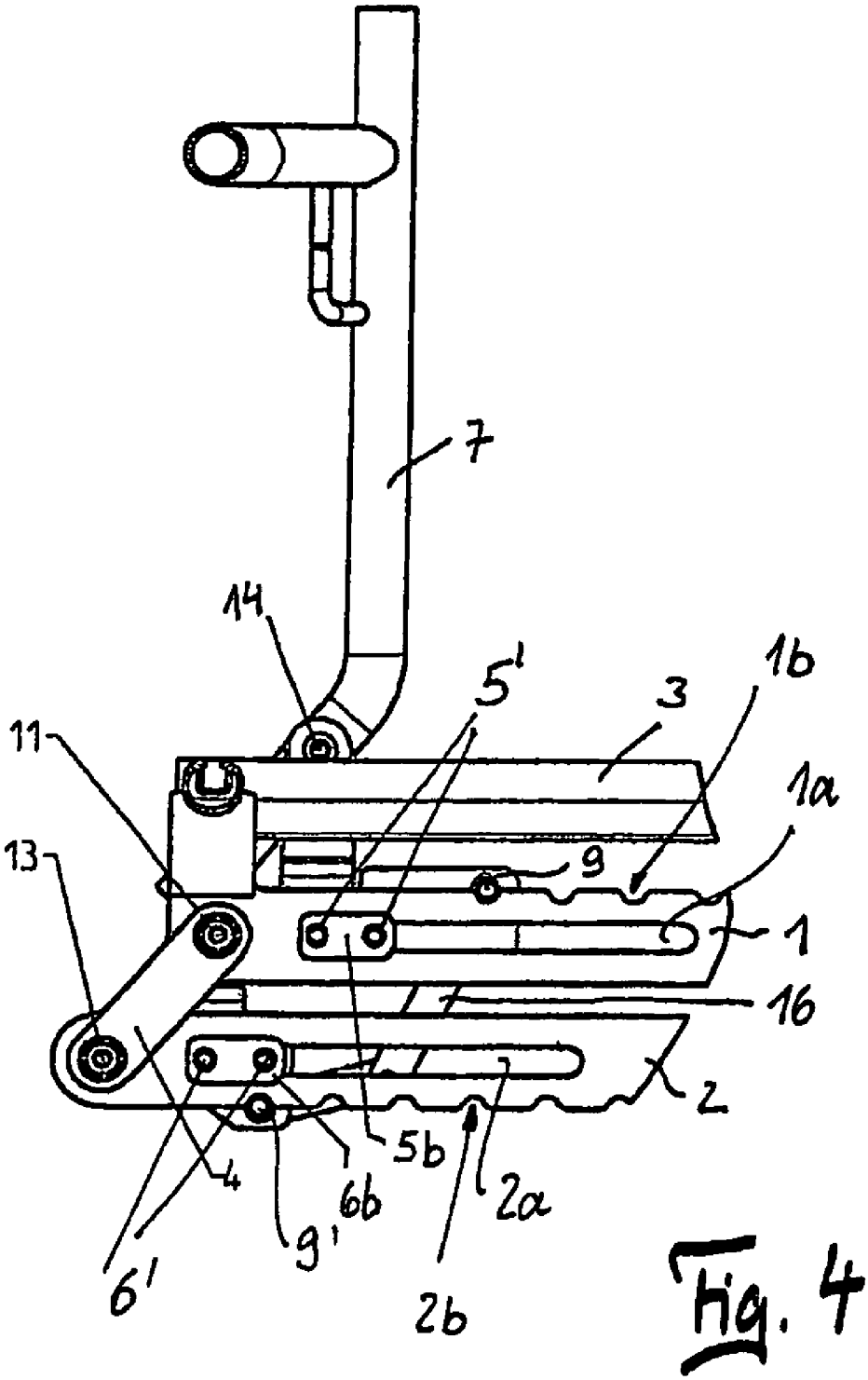
FIG. 4: The partial representation of the back view according to FIG. 3.
Figure 5:
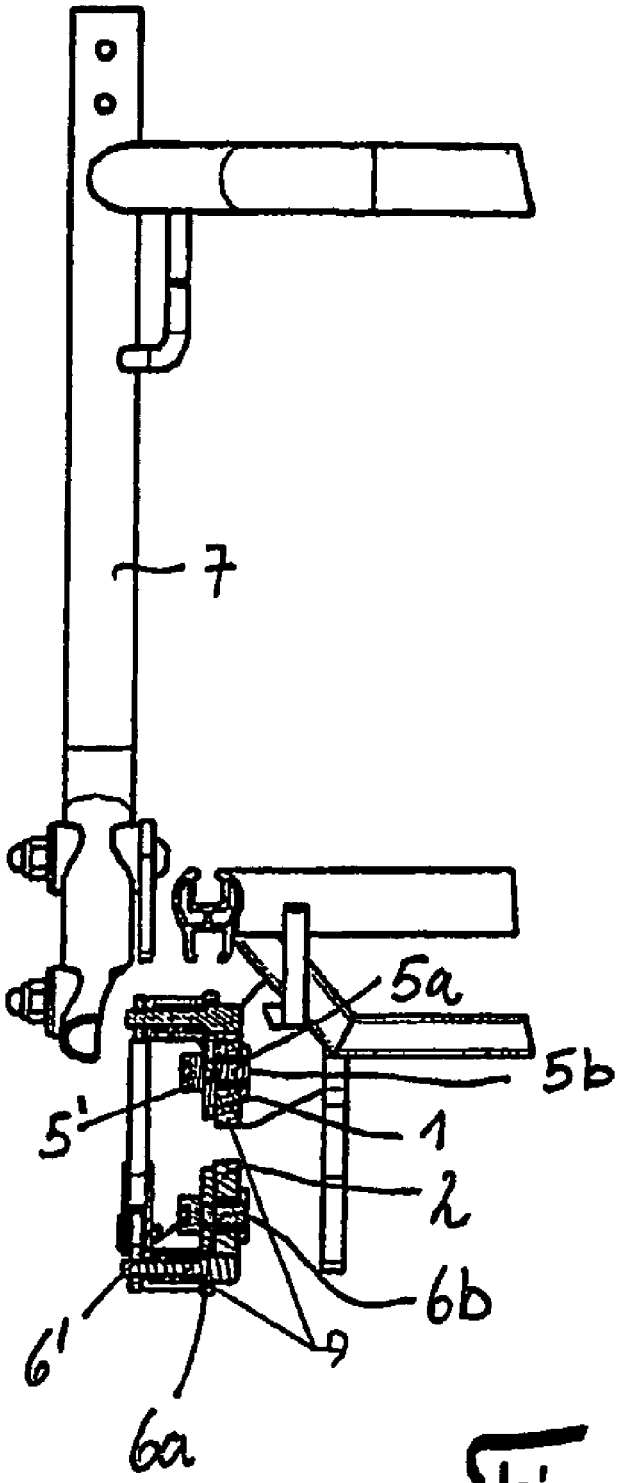
FIG. 5: The cut along the V-V line according to FIG. 3.

The longitudinal tracks 1, 2 have a longitudinal slot 1*a*, 2*a* in the back area which is closed on the peripheral side. Slide blocks 5*a*, 6*a* which are attached to plates 5, 6 (see FIG. 5) slide into the slots 1*a*, 2*a*. Via faceplates 5*b*, 6*b*, the slide blocks 5*a*, 6*a* are secured into slots 1*a*, 2*a* and/or the plates 5, 6 are braced against the longitudinal tracks 1, 2. On the plates 5, 6, the backrest 7, which has a cross strut 7*a*, is attached via hinges 14, 15. On the opposite end of the plates 5, 6, a three-piece grip unit 16 is attached. On the grip unit 16, which is attached to plates 5, 6 via a hinge, there is an upper pin 9 and a lower pin 9'. The pins 9, 9' function together with the recesses 1*b*, 2*b*, which are provided on the upper side of track 1 or the lower side of track 2 and serve as a connector for the backrest 7 in the longitudinal direction. The angle between the recesses 1*b*, 2*b* (see FIG. 4) represents the angle of the sections between the hinge points 10, 12 and 11, 13.

In order to adjust the backrest 7 and the seat depth X, the faceplates 5*b*, 6*b* connected via screws 5', 6' with plates 5, 6 are loosened, both grip units 16 are separated so that the locking pins 9, 9' come out of the recesses 1*b*, 2*b* and the backrest 7 can then be moved forward or backward. The locking pins 9, 9' are inserted in to the relevant recesses 1*b*, 2*b* and screws 5', 6' are tightened again.

Figure 6:
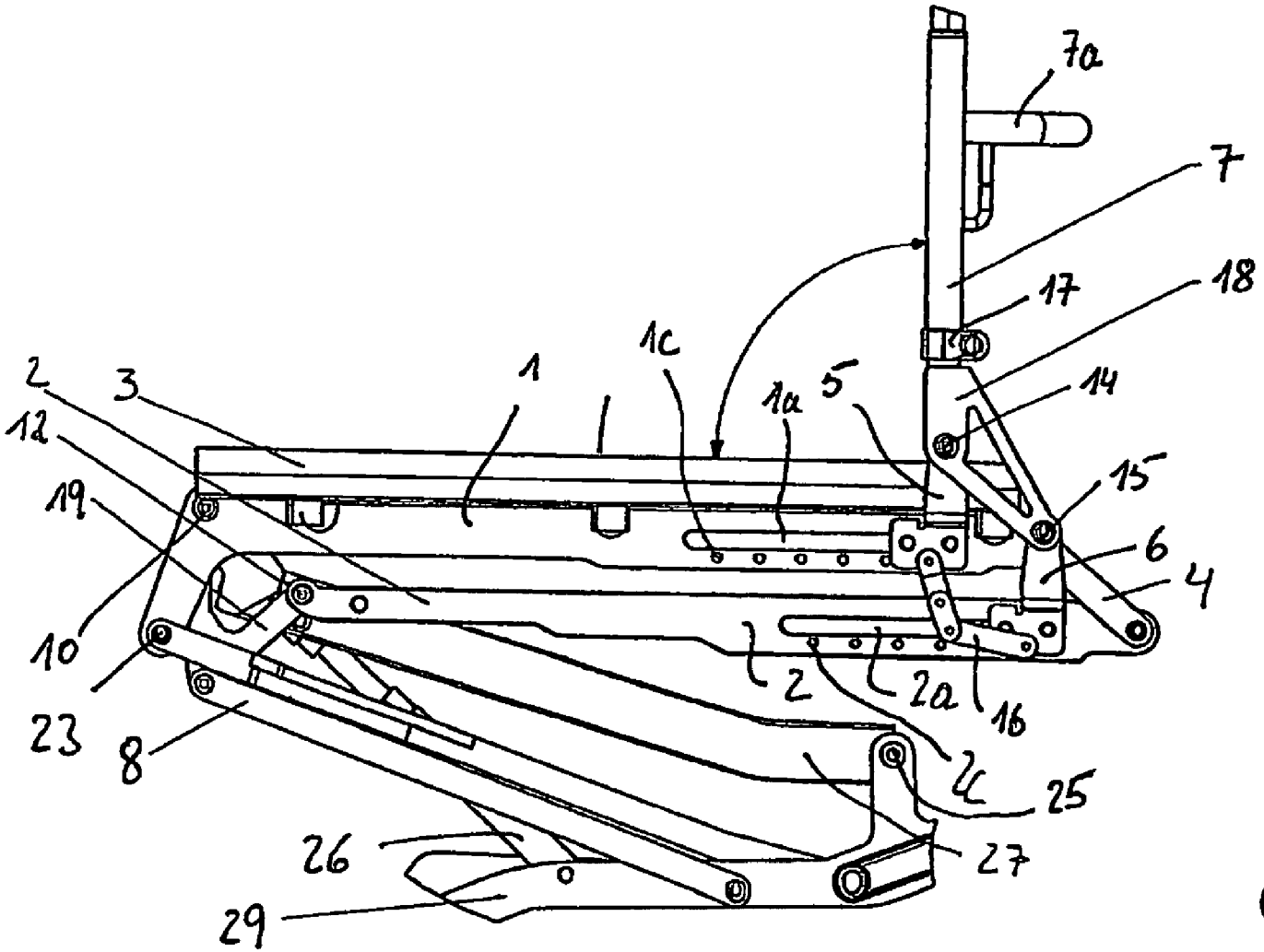
FIG. 6: The uplift unit in a side view.
Figure 8:
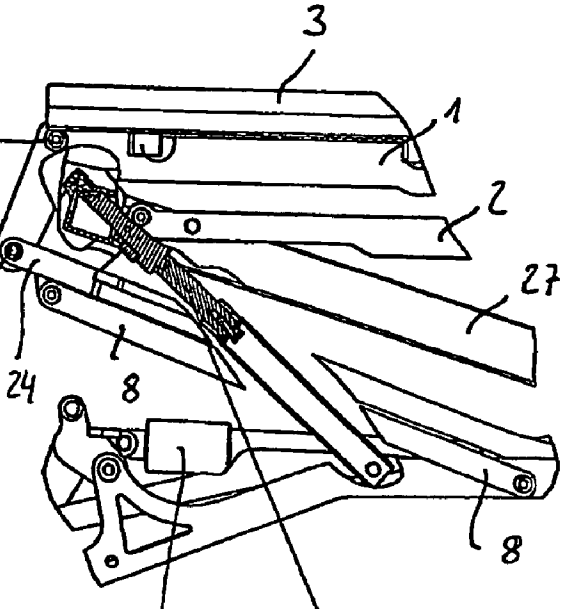
FIG. 8: A partial side view of the uplift unit
Figure 7:
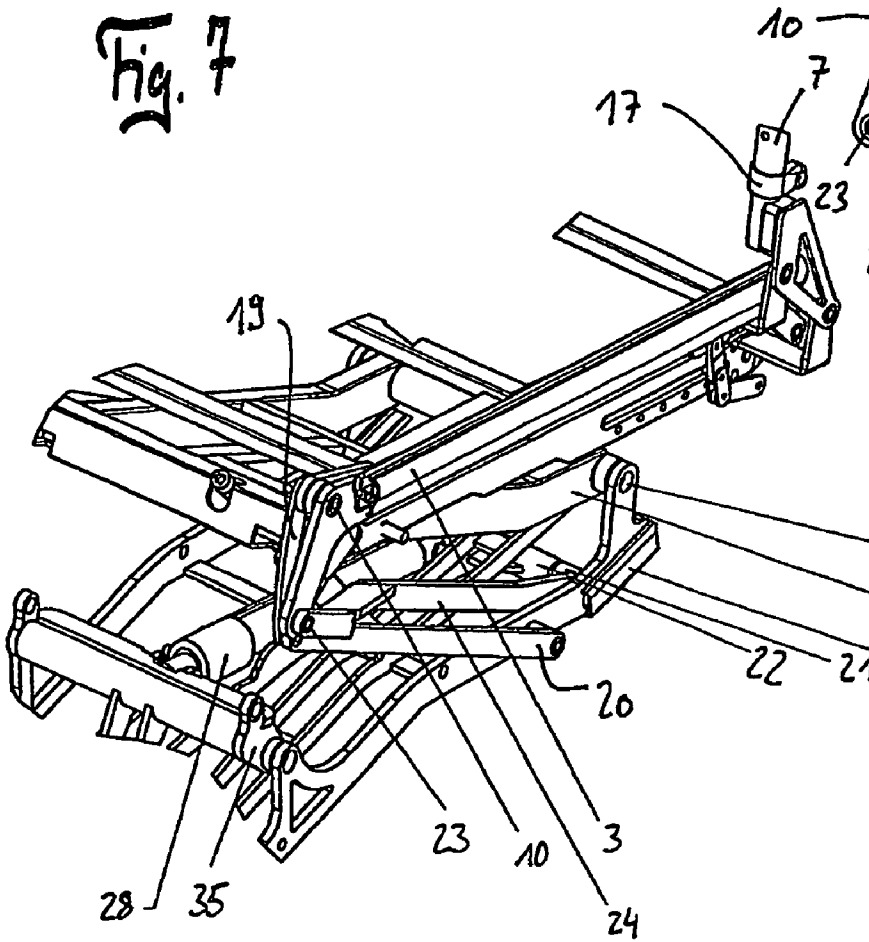
FIG. 7: A perspectivist representation of the uplift unit
Figure 10:
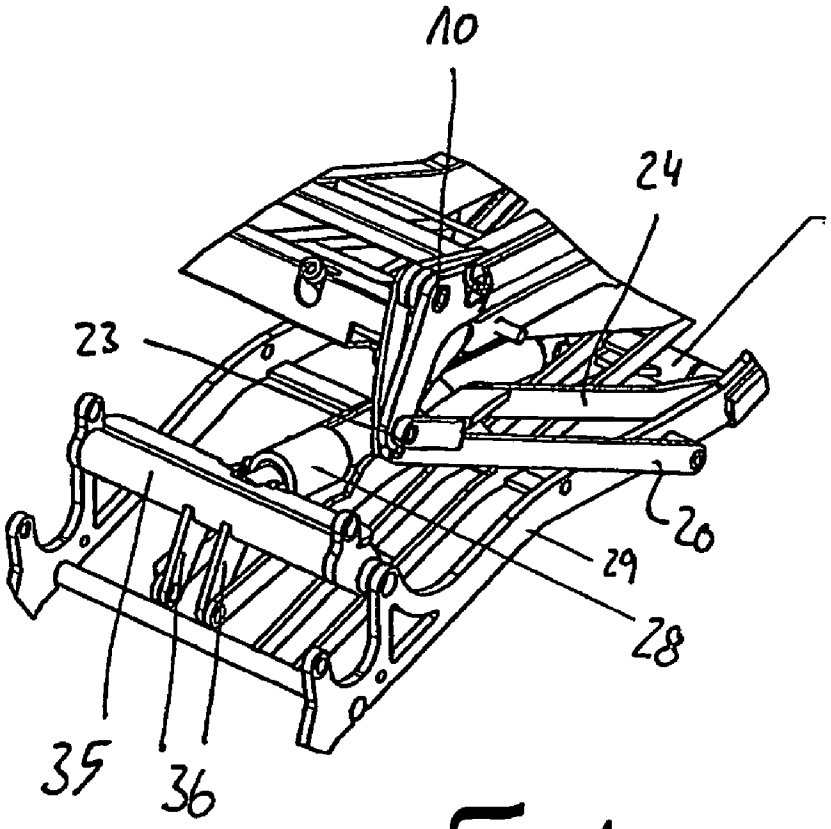
FIG. 10: An additional perspectivist view of the uplift unit.
Figure 9:
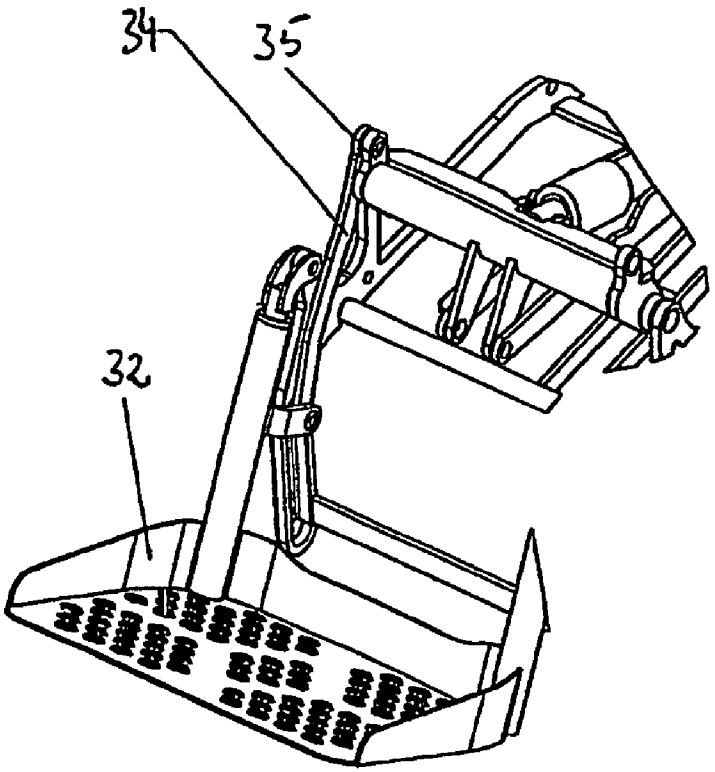
FIG. 9: A perspectivist representation of a part of the uplift unit.

As shown in FIG. 6, instead of recesses 1*b*, 2*b* at regular intervals, there may also be bores 1*c*, 2*c* under the slots 1*a*, 2*a*, into which the locking pins 9, 9' can snap. The backrest 7 can consist of two parts and be connected via clamps 17 to the uplift unit 33. This type of design has the advantage that the backrest 7 is quick and easy to remove if the standing wheelchair needs to be transported in a vehicle.

The lower part of the backrest 7 connected with plates 5, 6 via hinges can be formed in one piece with the backrest 7 or can use a triangular guide 18. By changing the distance D of hinge points 11, 13 and B of 12, 13, the angle $\alpha$ of the backrest 7 is adjusted relative to the seat 3.

In the figures one can see that the seat 3 is positioned on a parallelogram made up of the upper longitudinal track 1, the lower longitudinal track 2, as well as the guides 4, 19 connecting the front and back hinge points. For adjustment of the height of the seat 3, the hinge parallelogram 10-12, 11-13 is pushed up and rearward on an arc using a self-locking spindle 26 without changing an incline angle of the seat 3. Working together with the spindle 26 are the longitudinal strut 27, which is connected at its front end to the lower longitudinal track 2 in hinge point 12 and is located on the chassis with its back end in hinge point 25, as well as the steering strut 24, its lower end also being located on the chassis 29 and its upper end located on the upper longitudinal track 1 in another hinge point 23. The balance strut 8 is located above the hinge plate 19 attached to its front end in connection with hinge point 12 of the lower track 2 and the hinge point 10 of the upper track 1. On its lower end, the balance strut 8 is attached to the chassis 29 with a hinge plate. The hinge plate 19 and the balance strut 8 have the task of holding the hinge point 12 in position during raising and lowering of the seat 3. In this way, the backrest angle $\alpha$ only changes slightly during the up and downward motion of the seat 3.

The foot support 32 is attached via bilateral hinged vertical struts 34 and is dropped vertically by the actuator 28 with the uplift of the seat 3. The bell crank 35, which is attached via the guide 36 to the actuator 28, changes the rotational movement into a vertical movement.

The length of the spindle 26 is adjustable using a non-represented tool. Instead of the spindle 26, a pneumatic spring or electrical linear adjustment may be used as a hub unit.

Through a change in the position of the hinge point 21, the angle of the seat 3 can be influenced.

REFERENCE LIST

1 upper longitudinal track
1*a* slot/longitudinal slot
1*b* recess
1*c* hole/bore

2 lower longitudinal track
2*a* slot/longitudinal slot
2*b* recess
2*c* hole/bore
3 seat
4 guide
5 plate
5*a* slide block
5*b* faceplate
5' screw
6 plate
6*a* slide block
6*b* faceplate
6' screw
7 backrest
7*a* cross strut
8 balance strut
9 locking pin
9' locking pin
10 hinge/hinge point
11 hinge/hinge point
12 hinge/hinge point
13 hinge/hinge point
14 hinge point
15 hinge point
16 grip unit
17 clamp
18 guide
19 guide
20 balance strut
21 hinge/hinge point
22 cross strut
23 hinge point
24 steering strut
25 hinge point
26 hub unit/spindle
27 longitudinal strut
28 actuator
29 chassis
30 drive wheel
31 steerable wheel
32 foot support
33 uplift unit
34 vertical strut
35 bell crank
36 guide

I claim:

1. A standing wheelchair including a chassis onto which two drive wheels and at least one steerable wheel are attached, the standing wheelchair comprising:

a seat;

a backrest positioned at a back end of the seat;

at least one foot support positioned generally forward of and below the seat; and an uplift unit coupled to the seat, the backrest and the foot support, the uplift unit configured to raise and lower the seat and provide coordinated movement of the foot support, wherein the uplift unit supports the seat by an upper longitudinal track connected to and positioned below the seat, the upper track including front and back hinge points, a lower longitudinal track connected to and positioned below the upper track, the lower track including front and back hinge points and front and back guides, the front guide attached to the upper and lower track front hinge points and the back guide attached to the upper and lower track back hinge points, forming a parallelogram, and a hub unit connected to the parallelogram formed by the upper and lower tracks and front and back guides, the hub unit moving the parallelogram upwards and rearward for adjustment of the seat height, without significant changes to an incline angle of the seat or the relative position of the upper and lower tracks.

2. The standing wheelchair according to claim 1, wherein the uplift unit further comprising a longitudinal strut connected at a front end of the longitudinal strut to the front hinge point of the lower track and at a back end of the longitudinal strut to a hinge point on the chassis and a steering strut connected at a front end of the steering strut via a hinge to the upper track and at a back end of the steering strut via a hinge to the chassis, the longitudinal and steering struts working in conjunction with the hub unit to raise and lower the seat.

3. The standing wheelchair according to claim 1, wherein the seat comprises a stageless adjustment of seat depth relative to the backrest.

4. The standing wheelchair according to claim 1, wherein the hub unit comprises at least one spindle.

5. The standing wheelchair according to claim 4, wherein the spindle is self locking.

6. The standing wheelchair according to claim 1, wherein the back ends of the upper and lower tracks each comprise a slot and wherein the backrest is mounted within both slots by lower ends of the backrest.

7. The standing wheelchair according to claim 6, wherein the backrest comprises slide blocks which slide into the slots and which are fixable on opposite sides of the upper and lower tracks.

8. The standing wheelchair according to claim 7, wherein each slide block is connected to a plate, and each plate is connected to the backrest via a hinge.

9. The standing wheelchair according to claim 6, wherein the upper and lower tracks include recesses positioned parallel to and offset from the slots, and wherein the backrest comprises a plurality of locking pins positioned for insertion into the recesses.

10. The standing wheelchair according to claim 9, wherein the backrest further comprises a multi-section grip unit and the locking pins are located on the grip unit.

11. The standing wheelchair according to claim 10, wherein the grip unit includes multiple parts that are connected via hinges.

12. The standing wheelchair according to claim 9, wherein the recesses are located at regular intervals.

13. The standing wheelchair according to claim 1, wherein the uplift unit further comprises a balance strut connected at a front end of the balance strut with a hinge to one of the front and back guides and at a back end of the balance strut with a hinge to the chassis.

* * * * *